United States Patent [19]

Chardon et al.

[11] Patent Number: 4,640,317

[45] Date of Patent: Feb. 3, 1987

[54] WOVEN STRAPS WITH TRANSVERSE CONTRACTIONS

[75] Inventors: Georges Chardon, Saint-Etienne; Andre Chomienne, Saint-Chamond, both of France

[73] Assignee: Faure Roux, Saint-Chamond, France

[21] Appl. No.: 666,910

[22] Filed: Oct. 31, 1984

[30] Foreign Application Priority Data

Nov. 3, 1983 [FR] France ..... 8317761

[51] Int. Cl.[4] ..... D03D 47/42

[52] U.S. Cl. ..... 139/431; 139/432; 139/48

[58] Field of Search ..... 139/11, 48, 116, 118, 139/188 R, 431, 432

[56] References Cited

U.S. PATENT DOCUMENTS

| | | | |
|---|---|---|---|
| 694,108 | 2/1902 | Nierhaus et al. | 139/48 |
| 1,735,467 | 11/1929 | Lipper | 139/48 |
| 3,016,068 | 1/1962 | Felix | 139/188 |
| 3,126,920 | 3/1964 | Libby | 139/118 |
| 4,436,121 | 3/1984 | Cheyuet | 139/432 |

FOREIGN PATENT DOCUMENTS

| | | |
|---|---|---|
| 22551 | 6/1882 | Fed. Rep. of Germany . |
| 629036 | 11/1927 | France . |
| 1249099 | 2/1960 | France . |
| 1395815 | 3/1964 | France . |

*Primary Examiner*—Henry S. Jaudon

*Attorney, Agent, or Firm*—Steele, Gould & Fried

[57] ABSTRACT

The invention concerns woven straps having transverse contractions, as well as a method and apparatus for their manufacture. Contractions are formed along straps having a continuous unchanging weave and continuous selvedge by altering spacing of warp yarns during weaving. The warp yarns are spaced by a V or fan shaped support which is vertically movable to cause corresponding width variations in the straps.

6 Claims, 11 Drawing Figures

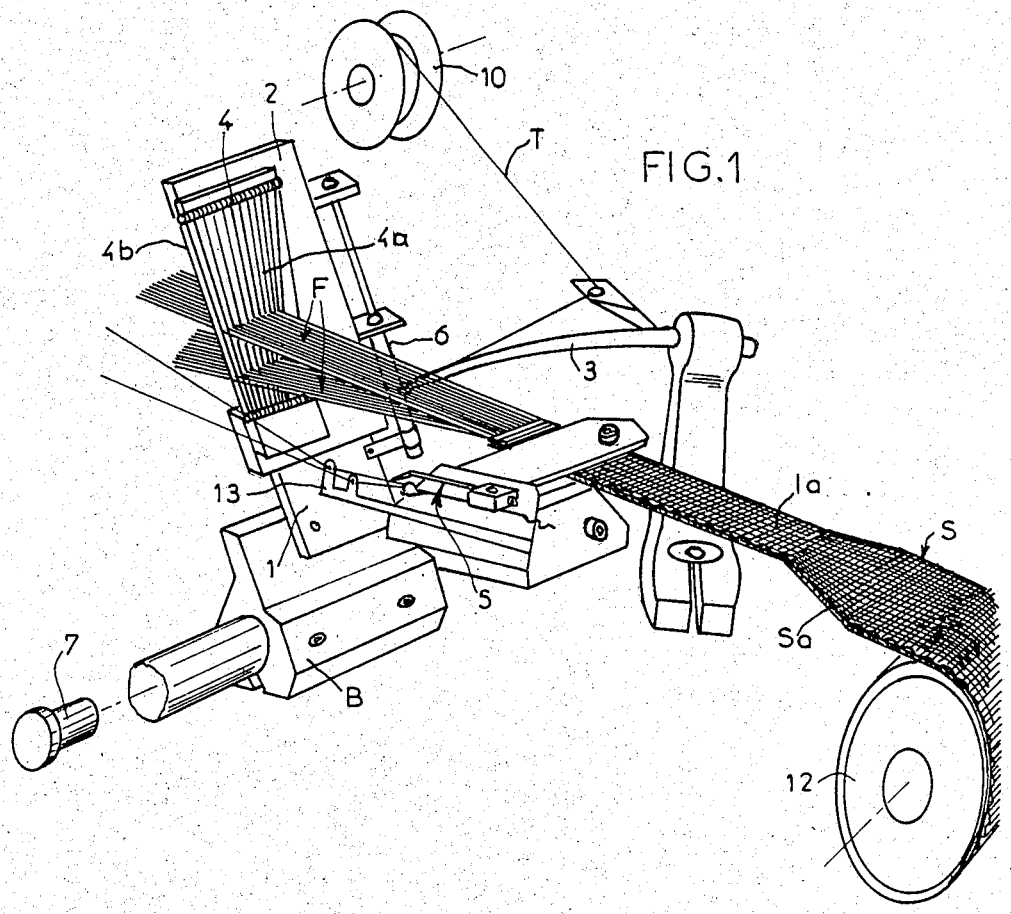
FIG.1
FIG.2
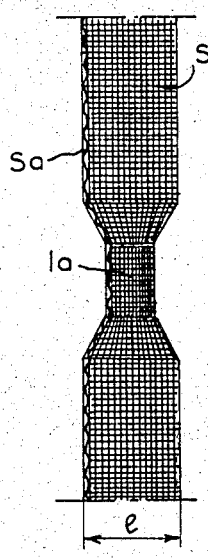
FIG.3
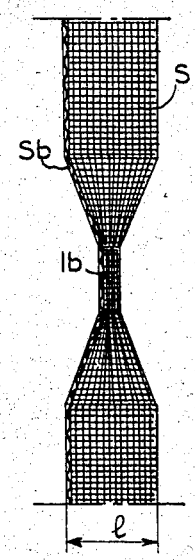
FIG.4
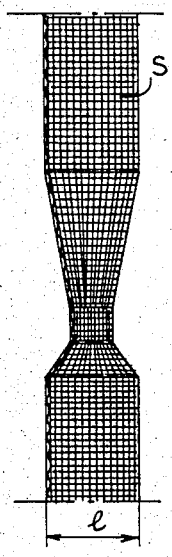
FIG.5
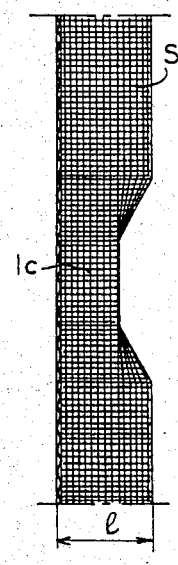
FIG.6
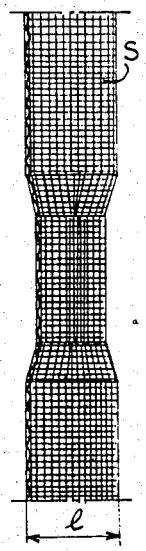

FIG. 7
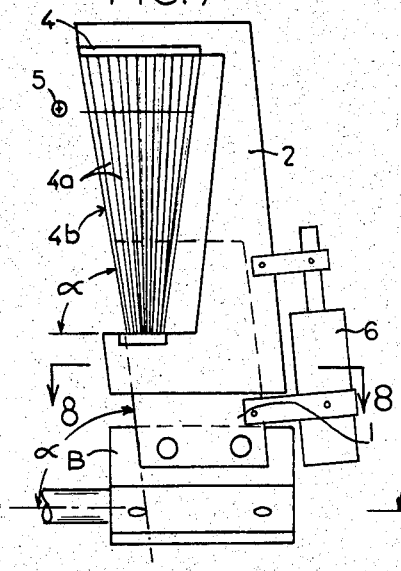
FIG.9
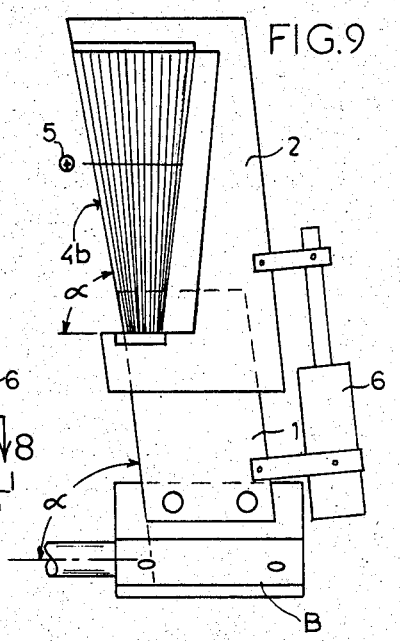
FIG.10
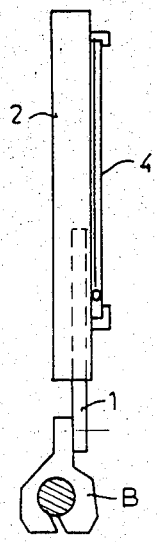
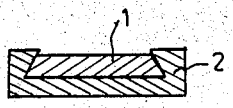
FIG.8
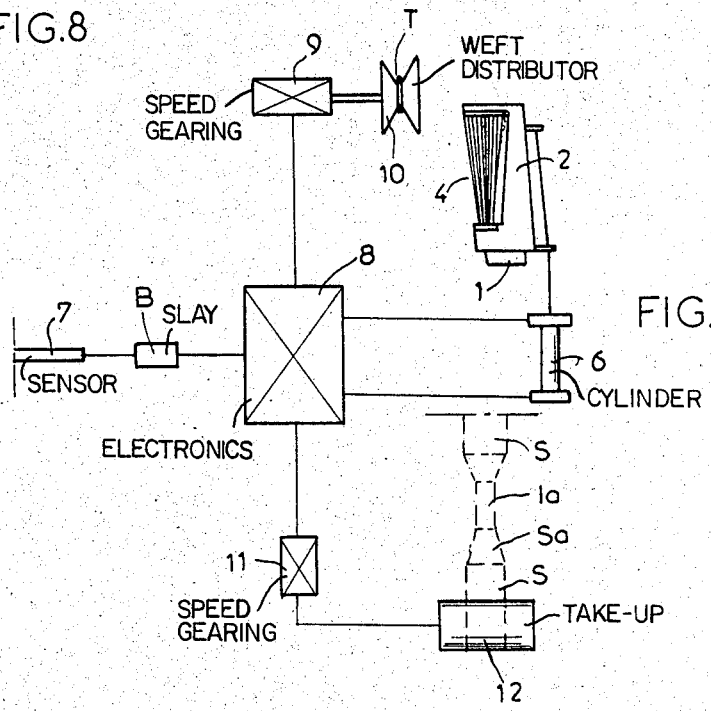
FIG.11

WOVEN STRAPS WITH TRANSVERSE CONTRACTIONS

BACKGROUND OF THE INVENTION

1. Field of the Invention

The invention relates to straps with transverse contractions provided locally along varying lengths, intended for positioning said straps within a securing means such as a mooring shackle.

2. Prior Art

Straps with transverse contractions have been obtained on shuttle looms, either by means of a texture change taking place at right angles to the contractions, or by omitting warp yarns, or by exercising a tensile stress on the weft yarn in order to bring nearer transversely the warp yarns, or still by the use of special reeds. The French Pat. No. 1,395,815 may for instance be referred to, in which there is shown the embodiment of a fabric with contractions on a shuttle loom, more particularly for manufacturing neck-ties.

The straps made on shuttle looms shown irregularities in the appearance, flexibility and thickness, more particularly at right angles to the contractions. Moreover, the cost for manufacturing them is high by reason of the low output, resulting from the low working speed of this type of loom.

To obviate these disadvantages, it was necessary to manufacture woven straps with localized contractions on automatic sickle looms having a very high output rate. The manufacture of straight straps without contraction on this type of loom is known, for instance from the teachings of the French Pat. No. 1,249,049. As shown in the figures in that patent, an automatic sickle loom operates, generally speaking, by passing a weft yarn carried by a sickle back and forth across the advancing warp yarns, a selvedge being formed by a chain stitch running along an endmost of the warp yarns. The selvedge is formed by chain stitching a selvedge thread into the warp yarns, by chaining the loops defined by warp yarns, or both. A needle is disposed to move fore and aft during formation of the chain stitch, the needle remaining in a plane parallel to the endmost warp yarn. The needle does not move transversely of the warp yarns during operation.

To manufacture such a kind of product on automatic sickle looms, it has been necessary to solve important engineering problems which did not arise with a shuttle loom. For instance, it is absolutely necessary to maintain a steady spacing between the outermost blade of the reed and the needle in order to obtain the continuity of the formation of the chain at right angles to the rectilinear selvedges of normal or reduced width, and the connecting flared selvedges.

This problem does not exist in a shuttle loom, wherein the reed is merely actuated with up and down vertical reciprocating motion.

SUMMARY OF THE INVENTION

The purpose of the present invention has been the manufacture, in a simple, efficient and rational manner, of straps with transverse contractions on automatic sickle looms. As characterized by the appended claims, the invention solves the problem consisting in the creation of a strap which, regardless of the weaves to be used in the wide portions and the narrow portions, is provided, on one side, with a selvedge formed by a chain stitch obtained by the work of the needle of the loom regardless of the binding system for the weft which is used, and on the opposite side with an actual selvedge which is obtained directly by the return of the sickle and of the weft.

The slay of the automatic sickle loom is equipped with a slanting guide on which is shifted upwardly by a suitable means a slide-block provided with a reed. The blades of the reed are disposed fan-wise and permit, in accordance with the positioning of said slide-block, either the constriction of the warp yarns for obtaining the restricted portions, or on the contrary the spacing of said warp yarns for the weaving of the normal width of the strap.

The angular slanting of the slide-block permits the outermost blade of the reed to be shifted within a plane running parallel to the plane of the knitting needle, in order to form the chain stitch of the selvedge regardless of the vertical positioning of the reed.

The main advantages of this invention are:

- the uniform weaving, flexibility and thickness of the strap, more particulary at right angles to the contractions;
- the quickness of the manufacture with one or more weaves, regardless of the types of weaves;
- the ability to obtain on the same loom, straps having contractions of varying widths and gradual flarings of varying lengths.

BRIEF DESCRIPTION OF THE DRAWINGS

The invention is set forth hereafter in a more detailed manner with reference to the attached drawings, in which a mode of embodiment only is shown. In the drawing:

FIG. 1 is a perspective view of an automatic loom at right angles to the sickle, equipped with the device according to the invention, for manufacturing woven straps with constricted portions.

FIGS. 2, 3, 4, 5 and 6 illustrate various types of straps made in accordance with the invention, by varying the spacing of the warp yarns and the tension of the weft yarns.

FIG. 7 is a front view illustrating the securing of the reed on the slide-block and the positioning thereof relative to the knitting needle, the reed being in a lower position (weaving of the wide portion of the strap).

FIG. 8 is a plane and sectional view along the line 8—8 of FIG. 7.

FIG. 9 is a front view similar to FIG. 7, however with the reed in the upper position (weaving of the narrow portion of the strap).

FIG. 10 is an outside profile view corresponding to FIG. 9.

FIG. 11 is a merely diagrammatical view illustrating the control, synchronized from the sensor, for the shifting of the reed, tension of the weft pay-out and the strap taking up drum.

DETAILED DESCRIPTION OF THE PREFERRED EMBODIMENTS

In accordance with the invention, the automatic sickle loom is equipped, for obtaining straps with localized transverse contractions, with a slideway (1) secured angularly on the bottom of the slay (B) so as to take a slanting position, as illustrated in the FIGS. 7 and 9 of the drawings.

Owing to its dovetailed contoured section, the slideway (1) permits a clevis-shaped reed holding slide-block (2) to be guided while allowing free sliding, the trapezoidal contour of this slide-block permitting the free passage of chain yarn sheet (F) stressed in a known manner by the sickle (3) for bringing up the weft yarn (T).

The slide-block (2) permits at right angles to the opening thereof the facial securing of a reed (4) the blades (4*a*) of which are disposed in a symmetrical V-shaped or fan arrangement, in order to provide between said blades a maximal spacing at right angles to the greater base, and on the contrary a minimal spacing at right angles to the smaller base.

It will be appreciated therefore that the upward shifting of the slide-block makes it possible to move apart or together the warp yarns (F) between them, in order to obtain either the normal width of the strap, or the reduced width with gradual flaring for the connection of these two portions.

It is important to consider that the angular securing in a slanting manner of the slideway (1), and therefore of the slide-block (2), permits the outermost blade (4*b*) of the reed (4) to be positioned substantially within a plane which is parallel to the plane of the shifting mobile needle (5) providing the formation of the chain stitches of the strap selvedge. This characteristic makes it possible during the upward travel of the slide-block (2) to obtain on one side the continuity of the formation of the chain at right angles to the recilinear selvedges of normal width or of reduced width, and to the flared connecting selvedges.

It will be also noted that the weft can be bound in accordance with several known systems, more particularly by the system with one or several filler yarns, obtained by the use of the finger (13) attached to the automatic sickle loom.

The means for shifting vertically in both directions the reed holding slide-block (2) is provided for instance by a pressure cylinder (6) secured to the slay (B) of the loom, the piston of said cylinder being connected to said slide-block (2) and movable either through pneumatic or mechanical means. The piston of said cylinder (6) is controlled automatically through the intermediary of each impulse of a sensor (7) positioned to detect the progress of the loom by detecting movement of a cyclically-movable part of the loom, following a stroke of a pre-determined and adjustable length. Consequently, the narrowing step of the strap (S) is gradual, in order to obtain thereby at will, on the one hand, the connection flarings (Sa–Sb) of varying lengths, and on the other hand, the contracted widths (1*a*–1*b*) of varying size, taking into account the magnitude of the stroke of the reed (4). These arrangements are illustrated in FIGS. 2, 3, 4, 5 and 6, in which there may be seen straps (S) of the same width (1) obtained directly on the sickle loom with contraction areas and flarings of varying size. It will be also noted, in accordance with FIG. 5, that the constricted portion (1*c*) of the strap (S) is provided with a rectilinear and continuous selvedge, provided either on the chain stitch side or on the actual selvedge side.

It must also be pointed out that the impulses of the sensor (7) are transmitted to an electronic device (8) provided with meters, which distributes the said necessary impulses, simultaneously by means of the upward shifting of the reed, controlling the tension of the weft yarn by adjusting variable-feed device (10) and to a drawing governor for the woven strap, as illustrated in FIG. 11.

Pay-out of the weft yarn by distributor 10 is controlled in response to a speed gearing device (9) coupled to the control system (6) for the reed (4) through the intermediary of the electronic control system (8) in order to appropriately controlled weft distributor (10). The distributor (10) for the weft (T) permits thus automatically the proportional slowing down of the distribution when the constricted widths (1*a*–1*b*) and the flarings (Sa–Sb) are being woven, in order to smoothly constrict the straps by coordinated control of yarn tension and yarn position. This distributor (10) may be of any known type, such as the type with near conical cheeks, as per FIG. 11, or still the half-positive type.

As mentioned above with reference to French Pat. No. 1,395,815, the width of woven straps can be varied by texture changes, omitting warp yarns, by special reeds, or by varying the tension applied to the weft yarn in order to thereby draw the warp yarns more closely together. As also noted above, in order to function as a sickle loom, it is necessary to precisely space the endmost warp yarn with respect to the needle 5. By controllably varying the warp spacing using positioning reed 4 and variable weft tensioner 10, it is possible to achieve a range of effects as shown in FIGS. 2–6. Symmetrical contractions are shown in FIGS. 2, 3, 4 and 6, made by reducing the pay-out rate of the weft thread and decreasing spacing of the warp yarns by upward displacement of reed 4. The decreased payout of weft, possibly with increased tension of the weft, does not displace the endmost warp yarn from its position because the position is defined by endmost reed 4*b* which remains at a constant space from the needle. A narrower strap is made because of the closer warp and reduced weft. However, the weaving operation is the same as with a wider strap. The finished strap in both cases symmetrical when pulled taut.

In FIG. 5, it is seen that non-symmetrical contractions can be achieved in which the contraction occurs in some of the warp yarns only. The endmost warp yarn is substantially straight. This effect is achieved by aligning some of the vanes of reed 4 parallel to endmost reed 4*b*, the reed 4 being asymmetrical.

The extent of tension and the extent of contraction as defined by movement of reed 4 and weft tension, can be varied as desired to achieve a mild contraction as in FIG. 6, a severe contraction as in FIG. 3 or an intermediate contraction as in FIG. 2. Moreover, by continuously varying the reed position and weft tension over the range between the maximum and minimum, the shape of the contraction can be varied as desired, for example as in FIG. 4. Even though the outermost vane blade 4*b* of the illustrated reed 4 is kept in a constant spacing relative to the reciprocal path of needle 5, at the same time symmetrically-constricted structures as shown in FIGS. 2, 3, 4 and 6 are woven. This occurs because the yarns of the finished structure are relatively positioned due to the tension of the weft and warp, and due to the displacement of the blades 4 during weaving.

A tension regulator is provided to adjust the tension of take-up of the receiving roll (12) of the strap and is influenced by a speed gearing device (11) which is also coupled to the control system of the reed (4) through the intermediary of the electronic control device (8). The result is a more important proportional stress when the constricted portions (1*a*–1*b*) and the flarings (Sa–Sb) are woven, in order to counterbalance the more important striking stress of the slay (B), as the stress is exercised on a smaller width.

It is preferred that the warp-positioning fan blade be mounted on the slay, and there made positionable by means of a pneumatically extensible cylinder 6. The slay is provided with an uppermost block 2 that is slidably movable relative to a lower portion 1 of the slay, and cylinder 6 is connected between these two portions to drive them apart or together. Block 2 slides with respect to stationary part 1 along a line parallel to outermost blade 4*b*. Therefore, when cylinder 6 is extended, the warp yarns are brought together and when cylinder 6 is retracted, the warp yarns are spaced apart. However, regardless of the spacing of the warp yarns, the endmost yarn remains in correct position with respect to needle 5 because block 2 slides along a line parallel to endmost reed 4*b*. A pneumatic cylinder 6 is preferred, but other mechanical arrangements are possible, such as threadably positionable members, extensible cylinders acting against spring forces, etc.

It will be obvious that the arrangements may also be possible adapted to ribbons or other similar items on any design of automatic loom.

It is also to be considered that in view of a better understanding of the drawings, the chain stitch side has been illustrated with an indented edge effect, whereas in the actual pattern this edge produces a rectilinear effect as the actual selvedge side edge.

We claim:

1. A method of weaving straps having a rectilinear portion and a transverse constricted portion, on an automatic sickle loom having a slay and a knitting needle, the needle being fixed against displacement transverse to the straps, the method comprising the steps of:

guiding warp yarns for the strap through a V-shaped support reed having converging blades, the support reed being positioned angularly on the slay of the loom in an oblique manner relative to the knitting needle, so as to maintain an edge of the reed in a plane parallel to the needle;

imparting a displacement to the support reed in said plane parallel to the needle to thereby cause the warp yarns to be spaced further from one another and to be brought nearer to one another during weaving while maintaining the endmost yarn in said fixed plane parallel to the needle; and, synchronizing and controlling the vertical displacement of the support reed with variation of weft feeding speed, strap tension and slay-striking stress, for production of said constricted portion and said rectilinear portion, respectively.

2. An apparatus for producing a woven strap having a knitted selvedge, a rectilinear portion and a localized transversely-constricted portion, the apparatus comprising:

an automatic sickle loom having a slay and a selvedge needle;

a vertical slideway mounted on the slay and disposed at an oblique angle with respect to warp yarns to be woven into the strap;

a slide block movably received in the slideway, the slide block having a plurality of blades diverging in a fan-shaped formation for guiding the warp yarns, means adapted to displace the slide block in a substantially vertical plane so as to cause variation in spacing of the warp yarns, and outermost blades of said block being positioned to hold an outermost warp yarn in a plane parallel to the working plane of said selvedge needle in all vertical positions of the slide block, the selvedge needle forming a selvedge of chain stitches which is continuous along the woven strap.

3. The apparatus of claim 2, wherein the means for vertically displacing the slide block comprises a pressure cylinder secured on a fixed part of the loom, and further comprises means including a sensor for driving the piston of said cylinder in a pre-determined stroke.

4. The apparatus of claim 3, further comprising a controller, a weft distributor and a speed-gearing device, the controller controlling linear speed of the weft distributor and the vertical displacement of the slide block such that the linear speed of the weft is decreased during formation of said constricted portions.

5. The apparatus of claim 4, further comprising a tension monitoring device and a strap takeup, the tension monitoring device and the strap takeup being coupled to the controller, the controller being operative to produce a drawing effect during formation of said constricted portions.

6. The apparatus of claim 5, comprising an electronic control device responsive to said sensor, the electronic control sychronizing operation of slide block, the weft distributor and the tension monitoring device.

* * * * *